United States Patent [19]

Roane

[11] 4,334,870

[45] Jun. 15, 1982

[54] TETRAHEDRON BLOCKS CAPABLE OF ASSEMBLY INTO CUBES AND PYRAMIDS

[76] Inventor: Patricia A. Roane, 1100 Fulton St. #7, San Francisco, Calif. 94117

[21] Appl. No.: 200,602

[22] Filed: Oct. 24, 1980

Related U.S. Application Data

[62] Division of Ser. No. 11,114, Feb. 12, 1979, Pat. No. 4,258,479.

[51] Int. Cl.[3] ..... A63H 33/04

[52] U.S. Cl. ..... 434/211; 46/24; 434/403

[58] Field of Search ..... 46/24, 25; 434/211, 434/403

[56] References Cited

U.S. PATENT DOCUMENTS

| | | | |
|---|---|---|---|
| 1,236,234 | 8/1917 | Troje | 46/24 UX |
| 2,795,893 | 6/1957 | Vayo | 46/24 |
| 2,939,243 | 6/1960 | Duggar | 46/24 |
| 3,925,959 | 12/1975 | Dykes | 46/24 X |
| 4,258,479 | 3/1981 | Roane | 434/211 |

FOREIGN PATENT DOCUMENTS

| | | | |
|---|---|---|---|
| 1316018 | 12/1962 | France | 434/211 |

*Primary Examiner*—Harland S. Skogquist

*Attorney, Agent, or Firm*—Owen, Wickersham & Erickson

[57] ABSTRACT

A series of interrelated sets of tetrahedron blocks. Each set comprises twelve blocks capable of assembly into a rectangular parallelepiped using all twelve blocks, and is also capable of assembly into an eight-block pyramid and a four-block tetrahedron. The pyramid and parallelepiped of all sets are the same height. The tetrahedrons are preferably hollow and each of them has a magnet for each face, e.g., affixed to the interior walls of its faces, the magnets being so polarized that upon assembly into a cube or pyramid, the magnets of facing faces attract each other. Preferably, the blocks are colored in such a way that faces of the same size and shape are colored alike and each size and shape has a different color.

13 Claims, 5 Drawing Figures

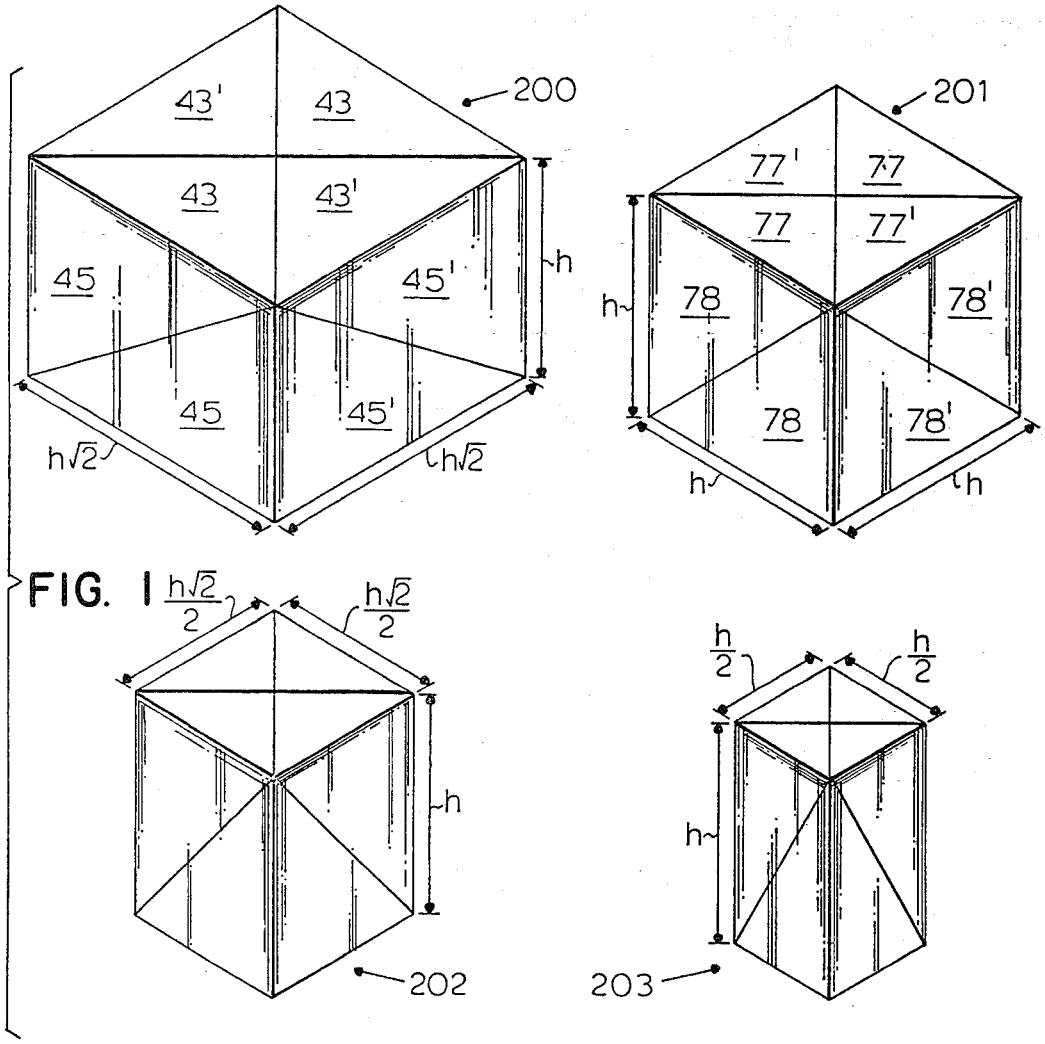
FIG. 1
FIG. 2
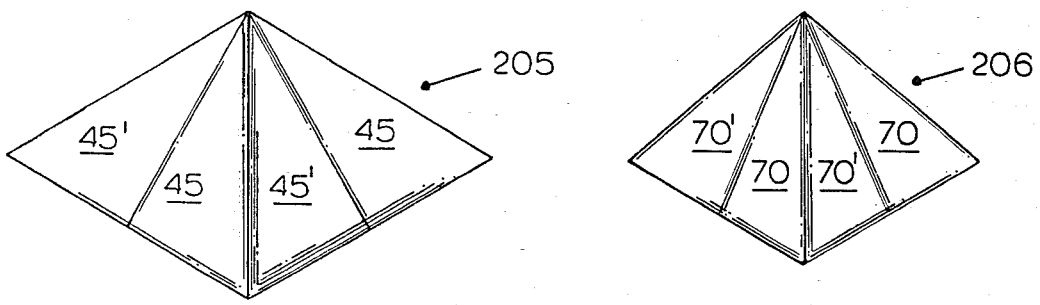

FIG. 3
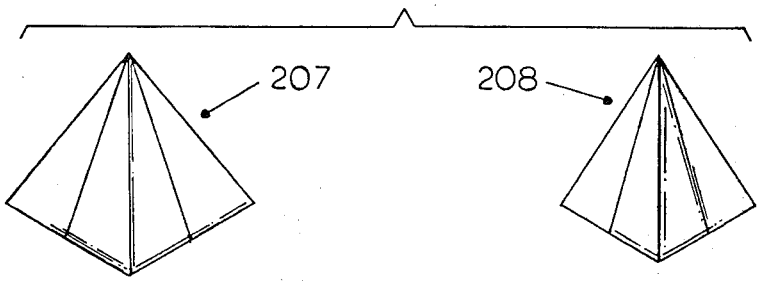
FIG. 4
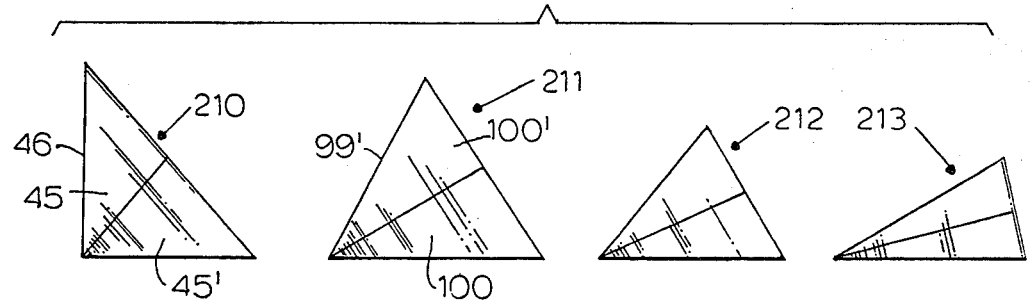
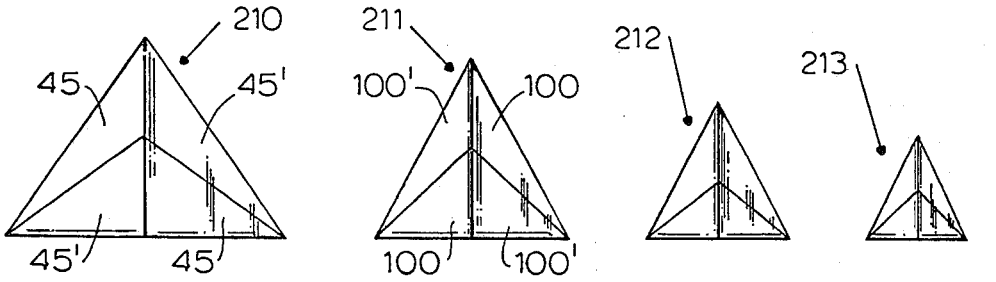
FIG. 5

TETRAHEDRON BLOCKS CAPABLE OF ASSEMBLY INTO CUBES AND PYRAMIDS

REFERENCE TO RELATED APPLICATION

This application is a division of application Ser. No. 11,114, filed Feb. 12, 1979, now U.S. Pat. No. 4,258,479.

BACKGROUND OF THE INVENTION

This invention relates to a group or groups of blocks, each of which is shaped as a tetrahedron.

Each set has twelve blocks and is capable of assembly into a rectangular parallelepiped; each set is also capable of assembly as an eight-block pyramid and a four-block tetrahedron. Many other solids may be formed from either such group.

The tetrahedron, the simplest polygonal solid, is of special interest, in that all other polygonal solid figures can be broken down into tetrahedrons. In this manner, a number of shapes can be produced by assembling various tetrahedrons. The group of blocks may be viewed either as an educational device for study of solids, as a playset for amusement of children or grownups, or as a puzzle for grownups or children.

In its educational aspect, a great deal can be learned about various solid figures, including not only pyramids and cubes but a great variety of figures, by superposition and interrelation of the tetrahedrons included in the sets of this invention. The blocks may be related to architecture and history, and also may lead to geometrical speculation.

When used either for play or as a puzzle, the invention provides numerous opportunities for assembling various shapes from the tetrahedrons. Storage is normally done by assembling them together in cubes or parallelepipeds or segments thereof; and when the blocks are all spread out it takes ingenuity and understanding to reassemble them into the cube, particularly a cube related to the particular set. As stated, pyramids or pyramidal groups may be constructed; so may octahedrons, and so on.

Thus, among the objects of the invention are those of enabling study and amusement, of facilitating observation, of improving manual dexterity, of illustrating relations between various solid figures, and so on, by the use of tangible blocks. These blocks are preferably made so that they can be held to each other magnetically; and they are also preferably colored, when the color relationship is helpful. To make the group more puzzling, of course, the color relationship may be avoided.

SUMMARY OF THE INVENTION

The invention comprises a group of tetrahedron blocks which may be grouped as a series of interrelated sets.

The invention demonstrates a harmony in which several each of seven tetrahedron blocks and their mirror counterparts, all having right-angle faces, come together in an orderly progression to form one system in a variety of configurations. Taken separately, multiple individual pairs can either combine as one-of-a-kind to form a variety of symmetrical polyhedrons, or combine with other one-of-a-kind pairs to form a variety of other symmetrical polyhedrons.

The tetrahedrons are preferably hollow, with magnets affixed to the interior walls of their faces, and the magnets are so arranged with respect to their polarization that upon proper assembly into a cube or pyramid the magnets of facing faces attract each other and help hold the blocks together. Without this, it is sometimes difficult to obtain or retain configurations that may be desired.

Color relationships may also be provided in order to help in assembly. Then color relationships can also be used to make other educational points.

In another arrangement, the invention is a combination of tetrahedrons with right-triangle faces which can be combined to form a cube and other solid figures. All tetrahedrons may be derived from a given basic square and seven primary triangles related thereto. The basic square may be folded corner to corner to form a smaller square, and so on, for the necessary times to define a total of four squares, for example, each diminishing in size from its predecessor. Of the seven primary triangles, one is an equilateral triangle and the other six are isosceles triangles. Each of the seven primary triangles incorporates a diagonal or one side of one of the squares, and each may be assigned a distinguishing color.

The squares and the interrelated seven triangular faces may be used to form seven symmetrical primary solids, namely, four distinct pyramids, all of equal height resting on four progressively enlarging squares, and three distinct equilateral tetrahedrons. All seven of these symmetrical solids are then halved and quartered so as to divide them into four equal parts. Then each of the pyramids is again divided so as to produce a total of eight equal parts. All eight parts, in all cases, are tetrahedrons with each face a right triangle.

Taken separately, from the largest to the smallest pyramid, each of which turns inside out to form a parallelepiped, the largest may be equal to two cubes (and it can in fact be reassembled into two equal cubes); the next, the medium, is equal to one cube, identical to the first two mentioned; the next, the smaller one, is equal to half the established cube; and the last, the smallest one, is equal to a fourth of a cube.

Furthermore, the rearrangement of a pyramid into a cube or a parallelepiped reveals that the pyramid is equal to $\frac{2}{3}$rds of its cube (or parallelepiped) while its matching tetrahedron is equal to $\frac{1}{3}$rd. This is revealed in the rearrangement of the largest of the pyramids (in which case only is its matching tetrahedron composed of pieces identical in shape to itself) into one of two cubes.

The invention, in this second arrangement, includes a group of tetrahedron blocks, consisting of four sets of twelve tetrahedron blocks each, each face of each block being a right triangle. Each set is capable of assembly as (a) a rectangular parallelepiped with upper and lower square faces and, alternatively, (b) a combination of a square-base pyramid with four identical isosceles triangular faces and a large tetrahedron with four identical isosceles triangle faces.

Of the four sets, a first set has as its parallelepiped a cube of height h, and its pyramid, also of height h, has its triangular faces equilateral; its large tetrahedron is also equilateral. The second, third, and fourth sets have their parallelepipeds of the same height h, and their length and breadth are, in each case, equal to each other and equal, respectively, to $h\sqrt{2}$, $h/\sqrt{2}$ and $h/2$; also, all their pyramids have the same height h, with the base length of every side of each being equal to h for the first said set and equal to $h\sqrt{2}$, $h/\sqrt{2}$, and $h/2$ for the other three sets, respectively. Finally, the faces of the large tetrahedrons are all mirror images of the faces of the pyramid of its set.

The second set consists of two matching subsets of six identical tetrahedron blocks each, those of one subset being symmetric to those of the other subset, while the first, third, and fourth sets comprising four subsets each, with two matching subsets a and b having four identical blocks each and symmetrical to those of its matching subset and two other matching subsets c and d, having two identical blocks each, and symmetrical to those of its matching subset. Being more specific, the tetrahedron blocks have the following edge lengths, where 1=shortest edge and $h=2\sqrt{2}$:

| SET | SUBSET | EDGE LENGTH |
|---|---|---|
| 4 | a,b | $1, 1, \sqrt{2}, 2\sqrt{2}, 3, \sqrt{10}$ |
| | c,d | $1, 1, 2\sqrt{2}, 3, 3, \sqrt{10}$ |
| 3 | a,b | $\sqrt{2}, \sqrt{2}, 2, 2\sqrt{2}, \sqrt{10}, 2\sqrt{3}$ |
| | c,d | $\sqrt{2}, \sqrt{2}, 2\sqrt{2}, \sqrt{10}, \sqrt{10}, 2\sqrt{3}$ |
| 1 | a,b | $2, 2, 2\sqrt{2}, 2\sqrt{2}, 2\sqrt{3}, 4$ |
| | c,d | $2, 2, 2\sqrt{2}, 2\sqrt{3}, 2\sqrt{3}, 4$ |
| 2 | | $2\sqrt{2}, 2\sqrt{2}, 2\sqrt{2}, 4, 4, 2\sqrt{6}$ |

Other objects and advantages of the invention and other related structures will appear from the following description of some preferred embodiments.

BRIEF DESCRIPTION OF THE DRAWINGS

In the drawings:

FIG. 1 is a group of parallelepipeds according to a second arrangement of the invention, each one being the same height as the other and each having a square base related to the height h as follows: $h\sqrt{2}$, h, $h/\sqrt{2}$, and h/2. Each one is made from twelve tetrahedrons in either (a) two subsets of six each, those of one subset being symmetrical to those of the other, or (b) four subsets of four, four, two and two, in pairs of symmetric subsets.

FIG. 2 is a group of two pyramids each made from eight of the two largest groups of tetrahedron blocks used in FIG. 1, both from two symmetric subsets of four each.

FIG. 3 is a similar view of two additional pyramids made from the blocks of the two smaller parallelepipeds of FIG. 1. Again, each pyramid is the same height and is made from two symmetric subsets of four blocks each.

FIG. 4 is a view in elevation of a group of four large tetrahedrons, each made from four tetrahedrons used in FIG. 1 and in two symmetric subsets of two blocks each.

FIG. 5 is another view in elevation from a different viewpoint of the large tetrahedrons of FIG. 4.

DESCRIPTION OF A PREFERRED EMBODIMENT

FIGS. 1 through 5 show an arrangement comprising a group of basic tetrahedron blocks, consisting of four sets of twelve tetrahedron blocks each, each face of each block being a right triangle. Each set is capable of assembly as a rectangular parallelepiped 200, 201, 202, or 203 of the height h with upper and lower square faces, as shown in FIG. 1. As shown in FIGS. 2–4, each set is also capable of assembly as a combination of a square-base pyramid 205, 206, 207, or 208 with four identical isosceles triangular faces (FIG. 2) and a large tetrahedron 210, 211, 212, 213 with four identical isosceles triangle faces, as shown in FIGS. 3 and 4.

In the set from which the figures 201, 206, and 211 are made, the parallelepiped 201 is a cube of height h, length h, and breadeth h; its pyramid 206 has equilateral triangular faces and has a height h equal to that of the cube; and its large tetrahedron 211 is also equilateral.

In the other three sets, the parallelepipeds 200, 202, and 203 are also of the same height h, and their length and breadth are each equal to each other, but they are respectively equal to $h\sqrt{2}$, $h/\sqrt{2}$, and h/2. For these sets, the base length of every side of each pyramid 205, 207, and 208 is the same and is equal, respectively, to $h\sqrt{2}$, $h/\sqrt{2}$, and h/2.

In all sets, the faces of the large tetrahedrons 210, 211, 212, and 213 are all mirror images of the faces of the pyramid 205, 206, 207, or 208 of its set.

In the instance of the largest set, that of the solids 200, 205, and 210, the set consists of two matching subsets of six identical tetrahedron blocks each, those of one subset being symmetric to those of the other subset. The other three sets consist of four subsets each, with two matching subsets a and b having four identical blocks each and symmetrical to those of its matching subset and two other matching subsets c and d having two identical blocks each and symmetrical to those of its matching subset.

The tetrahedron blocks have the following edge lengths, where 1=shortest edge, and $h=2\sqrt{2}$:

TABLE

| Edge Lengths Related to All Edges of All Tetrahedrons of FIGS. 1-5 | | | | |
|---|---|---|---|---|
| Parallelepiped | Pyramid | Large Tetrahedron | Subset | Edge Length |
| 203 | 208 | — | a,b | $1, 1, \sqrt{2}, 2\sqrt{2}, 3, \sqrt{10}$ |
| 203 | — | 213 | c,d | $1, 1, 2\sqrt{2}, 3, 3, \sqrt{10}$ |
| 202 | 207 | — | a,b | $\sqrt{2}, \sqrt{2}, 2, 2\sqrt{2}, \sqrt{10}, 2\sqrt{3}$ |
| 202 | — | 212 | c,d | $\sqrt{2}, \sqrt{2}, 2\sqrt{2}, \sqrt{10}, \sqrt{10}, 2\sqrt{3}$ |
| 201 | 206 | — | a,b | $2, 2, 2\sqrt{2}, 2\sqrt{2}, 2\sqrt{3}, 4$ |

TABLE-continued

| Parallelepiped | Pyramid | Large Tetrahedron | Subset | Edge Length |
|---|---|---|---|---|
| | Edge Lengths Related to All Edges of All Tetrahedrons of FIGS. 1-5 | | | |
| 201 | — | 211 | c,d | $2, 2, 2\sqrt{2}, 2\sqrt{3}, 2\sqrt{3}, 4$ |
| 200 | 205 | 210 | — | $2\sqrt{2}, 2\sqrt{2}, 2\sqrt{2}, 4, 4, 2\sqrt{6}$ |

The set used to make the parallelepiped 203 is made by bisecting the tetrahedrons in the set 202, and can be made into a cube by putting four parallelepipeds 203 together.

As can be seen, the tetrahedrons are readily assembleable into the parallelepiped or pyramid, and are preferably held together by magnetic forces.

The walls of the various tetrahedrons may be transparent or opaque, and they may be all the same color or same appearance, or to make assembly somewhat easier, all congruent faces, whether in one set or another, may be the same color and all different faces a different color. Each of the tetrahedrons may be hollow, with walls made, for example, of thin cardboard, plastic sheeting, wood, or metal. To the inner surface and at approximately the center of gravity of each face may be secured a suitable magnet, as by a suitable adhesive or by solder or other appropriate manner, with one of the poles of each magnet parallel to its face and closely adjacent to it. On all of the structures shown, faces identical in area are given the same magnetic polarization. This means that when assembling symmetric parts, the faces that are correctly aligned obtain, from the magnets, forces that tend to hold the parts together strongly enough so that assembly becomes possible. The magnetic force should, of course, more than counteract the forces of gravity while still being light enough so that the tetrahedrons are readily pulled apart by hand. Colors can be selected so that the sides which properly face each other can be identical. This is better adapted for getting everything together. If confusion is desired, the colors need not be used, or they can be used without any particular order; and this makes the whole perhaps more puzzling, though not necessarily more interesting.

Another system for color use involves having all of the isosceles right triangles blue, alternating according to size between azure blue and pale blue. Thus, the smallest isosceles right triangular faces would be azure blue, the next larger pale blue, the still larger ones azure blue again, and the largest faces pale blue again. This makes those triangles which are the same proportion be the same basic color, blue, with contrast between pale blue and azure blue adding to designs worked out by the blocks.

While the cubes form a very important relationship in use whether for play, instruction, or puzzling, they present only one aspect of the possible assemblies. It is possible to have a plurality of any one or more of the sets available so that further construction becomes possible. Pyramids are readily formed as are groups of pyramids, and from them, other interesting figures. The use of the magnets makes this all the more interesting because faces cannot be put together that repel each other. The various shapes that can be achieved by the use of matching sides together becomes quite interesting indeed.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A group of tetrahedron blocks, comprising:

a plurality of sets of twelve tetrahedron blocks each, each face of each block being a right triangle, each set being capable of assembly as (a) a rectangular parallelepiped with upper and lower square faces made up of twelve blocks, and, alternatively, (b) a combination of a square-base pyramid made up of eight blocks, with four identical isosceles triangular faces and a tetrahedron made up of four blocks, with four identical isosceles triangular faces, all the parallelepipeds and pyramids having the same height, the faces of the tetrahedrons all being mirror images of the faces of the pyramid of its set.

2. The group of claim 1 wherein:

one said set consists of two matching subsets of six identical tetrahedron blocks each, those of one subset being symmetric to those of the other subset, each other said set consisting of four subsets each, with two matching subsets having four identical blocks each and symmetrical to those of its matching subset and two other matching subsets having two identical blocks each and symmetrical to those of its matching subset.

3. A group of tetrahedron blocks, consisting of:

four sets of twelve tetrahedron blocks each, each face of each block being a right triangle, each set being capable of assembly as (a) a rectangular parallelepiped with upper and lower square faces and, alternatively, (b) a combination of a square-base pyramid with four identical isosceles triangular faces and a large tetrahedron with four identical isosceles triangular faces, a first said set having its parallelepiped a cube of height h, its pyramid having its triangular faces equilateral, and its large tetrahedron equilateral, second, third, and fourth sets having their parallelepipeds of the same height h, and their length and breadth each equal to each other and equal, respectively, to $h\sqrt{2}$, $h/\sqrt{2}$, and $h/2$, all the pyramids having the same height h with the base length of every side of each being equal to h for the first said set and equal to $h\sqrt{2}$, $h/\sqrt{2}$, and $h/2$ for the other three sets, respectively, the faces of the large tetrahedrons all being mirror images of the faces of the pyramid of its set.

4. The group of blocks of any of claims 1 to 3 wherein the rectangular blocks are hollow and each has magnets affixed to the inner side of its faces, with polarization such that upon assembly into its parallelepiped and also into its pyramid, the magnets of facing faces attract each other.

5. The group of blocks of any of claims 1 to 3 wherein faces of the same size and shape are colored alike, each size and shape having a different color.

6. The group of claim 3 wherein:

said second set consists of two matching subsets of six identical tetrahedron blocks each, those of one subset being symmetric to those of the other subset, said first, third, and fourth sets comprising four subsets each, with two matching subsets a and b having four identical blocks each and symmetrical to those of its matching subset and two other matching subsets c and d, having two identical blocks each, and symmetrical to those of its matching subset.

7. The group of claim 6 wherein the tetrahedron blocks have the following edge lengths, where 1=shortest edge, and $h=2\sqrt{2}$:

| Set | Subset | Edge Length |
|---|---|---|
| 4 | a,b | $1, 1, \sqrt{2}, 2\sqrt{2}, 3, \sqrt{10}$ |
| | c,d | $1, 1, 2\sqrt{2}, 3, 3, \sqrt{10}$ |
| 3 | a,b | $\sqrt{2}, \sqrt{2}, 2, 2\sqrt{2}, \sqrt{10}, 2\sqrt{3}$ |
| | c,d | $\sqrt{2}, \sqrt{2}, 2\sqrt{2}, \sqrt{10}, \sqrt{10}, 2\sqrt{3}$ |
| 1 | a,b | $2, 2, 2\sqrt{2}, 2\sqrt{2}, 2\sqrt{3}, 4$ |
| | c,d | $2, 2, 2\sqrt{2}, 2\sqrt{3}, 2\sqrt{3}, 4$ |

-continued

| Set | Subset | Edge Length |
|---|---|---|
| 2 | — | $2\sqrt{2}, 2\sqrt{2}, 2\sqrt{2}, 4, 4, 2\sqrt{6}$ |

8. A set of tetrahedron blocks consisting of twelve tetrahedron blocks, each face of each block being a right triangle, said set being capable of assembly as (a) a twelve-block rectangular parallelepiped with upper and lower square faces and, alternatively, (b) a combination of an eight-block square base pyramid with four identical isosceles triangular faces and a four-block tetrahedron with four identical isosceles triangle faces, the faces of the four-block tetrahedrons all being mirror images of the faces of the pyramid.

9. The set of tetrahedron blocks of claim 8 wherein the height h of the pyramid equals the height of the parallelepiped.

10. The set of claim 9 wherein the parallelepiped is a cube and the pyramid and four-block tetrahedron are equilateral.

11. The set of claim 9 wherein the length and breadth of the parallelepiped are equal to each other and to $h\sqrt{2}$ and the base length of each side of the pyramid equals $h\sqrt{2}$.

12. The set of claim 9 wherein the length and breadth of the parallelepiped are equal to each other and to $h/\sqrt{2}$ and are equal to the base length of each side of the pyramid.

13. The set of claim 9 wherein the length and breadth of the parallelepiped are equal to each other and to the base length of the pyramid and to h/2.

* * * * *